US007871222B2

(12) United States Patent
Ding et al.

(10) Patent No.: US 7,871,222 B2
(45) Date of Patent: Jan. 18, 2011

(54) TRUSS SEMI-SUBMERSIBLE OFFSHORE FLOATING STRUCTURE

(75) Inventors: Yun Ding, Sugar Land, TX (US); William Lawrence Soester, Sugar Land, TX (US)

(73) Assignee: J. Ray McDermott, S.A., Houston, TX (US)

( * ) Notice: Subject to any disclaimer, the term of this patent is extended or adjusted under 35 U.S.C. 154(b) by 67 days.

(21) Appl. No.: 12/037,341

(22) Filed: Feb. 26, 2008

(65) Prior Publication Data

US 2009/0158988 A1 Jun. 25, 2009

Related U.S. Application Data

(62) Division of application No. 11/332,707, filed on Jan. 13, 2006.

(51) Int. Cl.
*E21B 17/08* (2006.01)

(52) U.S. Cl. ..... 405/200; 405/204; 405/205; 114/264; 114/265

(58) Field of Classification Search ..... 114/264, 114/265; 405/200, 203, 204, 205
See application file for complete search history.

(56) References Cited

U.S. PATENT DOCUMENTS 6,340,272 B1 * 1/2002 Runge et al. ..... 405/203
6,666,624 B2 * 12/2003 Wetch ..... 405/205
6,761,124 B1 * 7/2004 Srinivasan ..... 114/264
6,884,003 B2 * 4/2005 Horton, III ..... 405/224.2

* cited by examiner

*Primary Examiner*—David J Bagnell
*Assistant Examiner*—Sean Andrish
(74) *Attorney, Agent, or Firm*—D. Neil LaHaye

(57) ABSTRACT

A semi-submersible structure. The hull includes four columns that are supported by two pontoons. The columns support the topsides and the topsides structural framing serves as horizontal framing between the columns. A truss frame is attached to the columns. The truss frame preferably includes heave plates. The truss frame extends downward below the pontoons a sufficient distance in the water such that it minimizes motions caused by environmental forces. The hull section and the truss space frame are constructed separately and assembled together at the offshore site where the structure is used for drilling and/or production.

3 Claims, 4 Drawing Sheets

TRUSS SEMI-SUBMERSIBLE OFFSHORE FLOATING STRUCTURE

RELATED APPLICATION INFORMATION

This application is a divisional of application Ser. No. 11/332,707 filed on Jan. 13, 2006.

FIELD AND BACKGROUND OF INVENTION

The invention is generally related to floating offshore structures and more particularly to semi-submersible floating offshore structures.

The semi-submersible is a type of floating structure that has vertical columns supporting topsides and supported on large pontoons. The structure is held in position by the use of spread mooring lines that are anchored to the seafloor. The semi-submersible has a number of unique characteristics compared with other floating structures such as a spar and TLP (tension leg platform). These advantages include: The semi-submersible has good stability because of a large footprint and low center of gravity for the topsides. The hull requires lower steel tonnage. The hull can be a new build or converted from an existing drilling semi. The semi-submersible may include drilling capability. The semi-submersible can support a large number of flexible risers or SCRs (steel catenary risers) because of the space available on the pontoons. The topsides can be integrated at quayside and thus reduce cost and save scheduling time. The semi-submersible has a relatively short to medium development schedule. The initial investment is relatively low.

The semi-submersible also has several deficiencies when compared with the spar and TLP. The most significant is the large heave motion because of the shallower draft and large pontoons. As a result, it has not been suitable for a dry tree riser arrangement. The dry tree riser arrangement has significant economic benefit for well completion, work-over, and intervention during the life of the offshore production facility. Another problem from the large motion of the semi-submersible is that it causes fatigue in the SCRs more easily, which requires more stringent fatigue design for the SCRs and thus costs more. For a platform in ultra deepwater with large diameter SCRs, the solutions to this problem could become technically or economically unfeasible.

The ideas that have been explored by the industry to overcome the semi-submersible motion problem generally fall into the two categories below.

The first is a deep draft semi-submersible. The concept is to increase the draft from the normal range from sixty to eighty feet to one hundred to one hundred ten feet so that the wave action at the keel is reduced and, thus, the structure will have less motion. This makes the semi-submersible option feasible in some locations where the conventional semi-submersible would not be chosen because of the difficulties in dealing with the SCR riser fatigue issues. However, the heave motion is still relatively large compared with spars and TLPs. Also, the dry tree arrangement is still not feasible. The SCRs deployed on the deep draft semi-submersibles usually still need to be strengthened to meet the fatigue life requirement.

The second is a semi-submersible with a heave plate. The basic idea is to add a heave plate or pontoon at the keel that extends in deep draft. The heave plate or pontoon adds damping and added mass to the platform which will reduce its heave motion under wave conditions.

Most concepts based on the heave plate have the heave plate or pontoon as an extendable part at the bottom of the semi-submersible hull. The heave plate or pontoon is retracted at the fabrication yard and during transportation. After the hull is located on site, the heave plate or pontoon is then extended or lowered to a deeper elevation and locked at that position.

The known designs suffer several deficiencies. The hull has to be a new build and conversion of an existing semi-submersible hull is not possible. The extendable columns take too much deck space. In some cases it could be as much as thirty percent of the total deck space, which is impractical from a topsides equipment layout point of view. The column-to-deck connections are complicated. They are hard to build, risky during installation, and difficult to maintain. The advantage of a large pontoon area for riser supports from the conventional semi-submersible hull is compromised.

SUMMARY OF INVENTION

The present invention addresses the deficiencies in the known art. The hull includes four columns that are supported by two pontoons. The columns support the topsides and the topsides structural framing serves as horizontal framing between the columns. Additional braces may be added between columns and topsides framing as necessary. A truss space frame is attached to the columns. The truss space frame preferably includes heave plates and possibly a keel tank. The truss space frame extends downward below the pontoons a sufficient distance in the water column that minimizes motions caused by wind and wave forces and eliminates the deficiencies in the known art. The hull section integrated with topsides and the truss space frame are constructed separately and assembled together at the offshore site where the structure is used for drilling and/or production.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
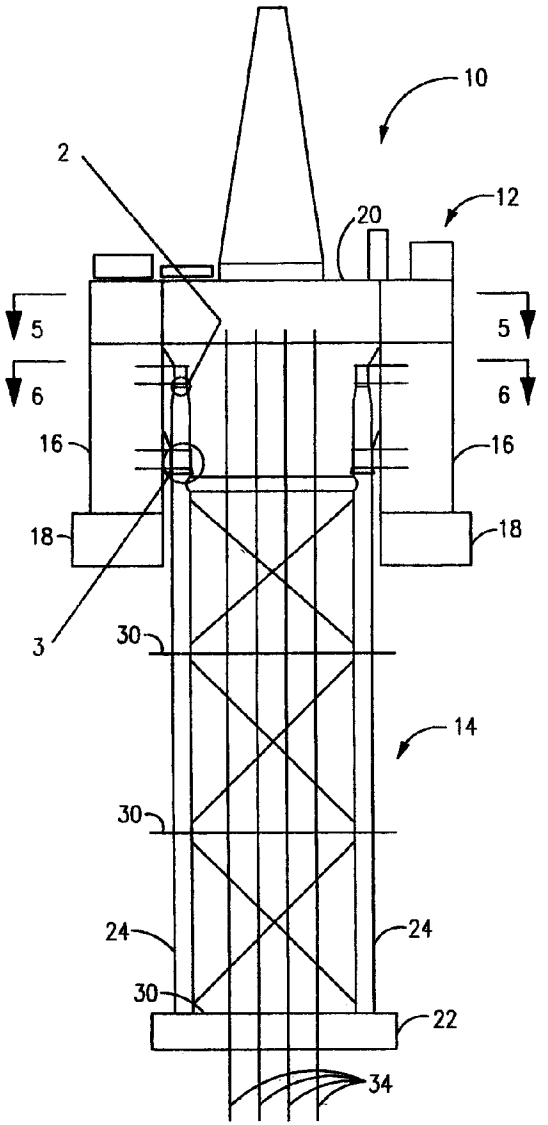
FIG. 1 is a side elevation view of the invention.
Figure 4:
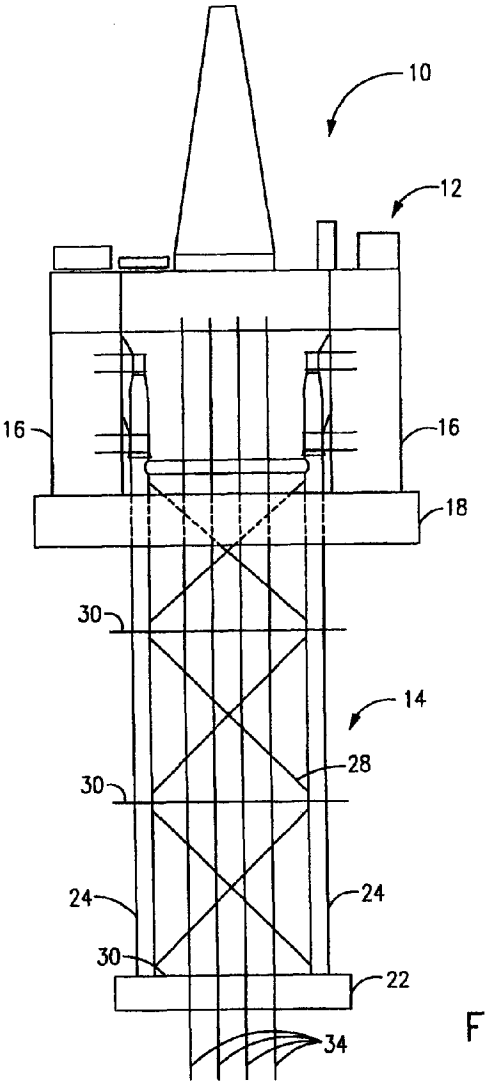
FIG. 4 is a side elevation view of the invention rotated ninety degrees from that in FIG. 1.

The invention is generally indicated by numeral 10 in FIGS. 1 and 4. Semi-submersible floating offshore structure 10 is generally comprised of a buoyant hull 12 and a truss frame 14.

The hull 12 is comprised of four columns 16 that are supported on their lower ends by at least two pontoons 18. The topside structural framing 20 serves as horizontal bracing between the columns 16. The general construction, arrangement, and assembly of the pontoons, columns, and topside structural framing is generally known. Additional braces 42, seen in FIG. 7, may be provided on the hull 12 if desired. For ease of illustration, the braces 42 are only shown in FIG. 7.

Even though the conventional semi-submersible hull design can be used for the invention, the preferred design is to use pontoons that are larger and deeper and columns that are smaller in cross section. This preferred arrangement will provide better control of motions that have been a source of the above-referenced problems with conventional semi-submersible designs.

As an alternative embodiment, more columns, not shown, can be provided between the two columns on the same pontoon. This would result in three or more columns on each pontoon.

The truss frame 14 is a space frame, preferably with a constant cross section. Adjustable ballast means may be included in the truss frame 14. One example of adjustable ballast means illustrated is in the form of a keel tank 22. When the keel tank 22 is used, it is normally flooded with sea water when the structure is at its ballasted, operating position. Heavier slurry material can also be used as fixed ballast if required by design. Other ballast means may include the use of ballast material in the legs 24 of the truss frame 14.

Figure 5:
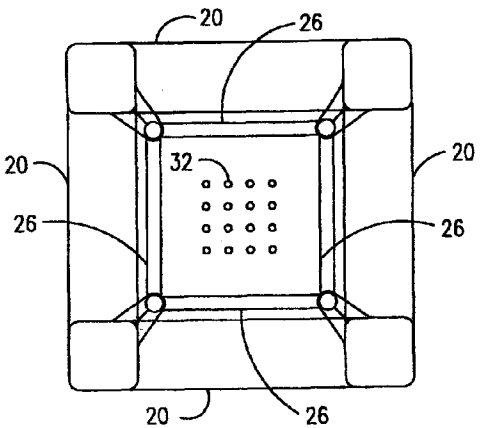
FIG. 5 is a view of the invention taken along lines 5-5 in FIG. 1.
Figure 6:
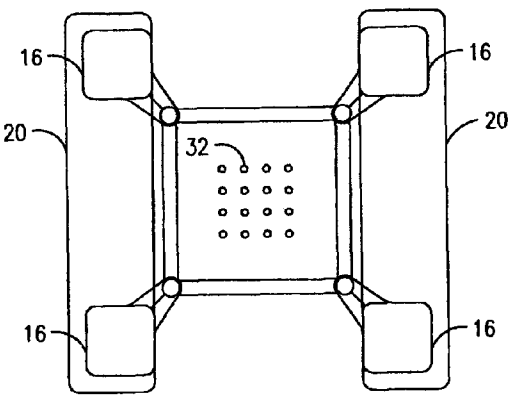
FIG. 6 is a view of the invention taken along lines 6-6 in FIG. 1.

The truss frame 14 is comprised of four truss legs 24 connected together with horizontal braces 26 (best seen in FIGS. 5 and 6) and X-braces 28. A horizontal plate 30 (heave plate) is attached to the truss frame 14 and preferably spans across the horizontal plane of the truss frame 14. While the horizontal plate 30 may be positioned at any vertical location on the truss frame 14, it is preferably provided at each horizontal framing location, except for the top framing location. The bottom horizontal plate 30 will include the keel tank 22 when it is included in the structure. The horizontal plates 30 are provided with bores 32 that allow passage of risers 34 used for drilling or production. However, the solid portion of the plates 30 preferably extends across the entire width and diameter of the truss frame 14 and also preferably are sized and formed so as to extend beyond the truss legs 24 as seen in FIGS. 1 and 4. Having the plates 30 extend beyond the truss legs 24 increases their effectiveness in controlling heave motions of the structure 10. While a number of horizontal plates 30 are illustrated, it should be understood that one or more plates may be used or, as seen in the alternate embodiment of FIG. 10, it is also possible to have no horizontal plates.

The horizontal plates 30 form bays between the plates in the frame that effectively trap a certain amount of water between the plates during movement caused by wave forces. The trapped water increases the effective mass of the structure and thus reduces the motions of the structure that are normally caused by these environmental forces.

The hull can be fabricated in the same way as a conventional semi-submersible with topsides integrated at a fabrication yard quayside. The truss frame can be fabricated in a similar manner to a conventional jacket in a fabrication yard.

Installation is carried out in the following manner.

The hull 12 with integrated topsides may be wet towed to the offshore site and connected to the mooring lines 44 in a similar manner to the installation of a conventional FPS (Floating, Production, and Storage structure) for storm safe securing of the structure. The truss frame 14 may be transported to the offshore site on any suitable vessel such as a material barge or a launch barge.

The truss frame is then put into the water either by any suitable means such as lift, launch, or float off. Once in the water, the truss frame 14 is upended and ballasted to a position in which the top portion of the truss legs 24 are above the water line.

Figure 7:
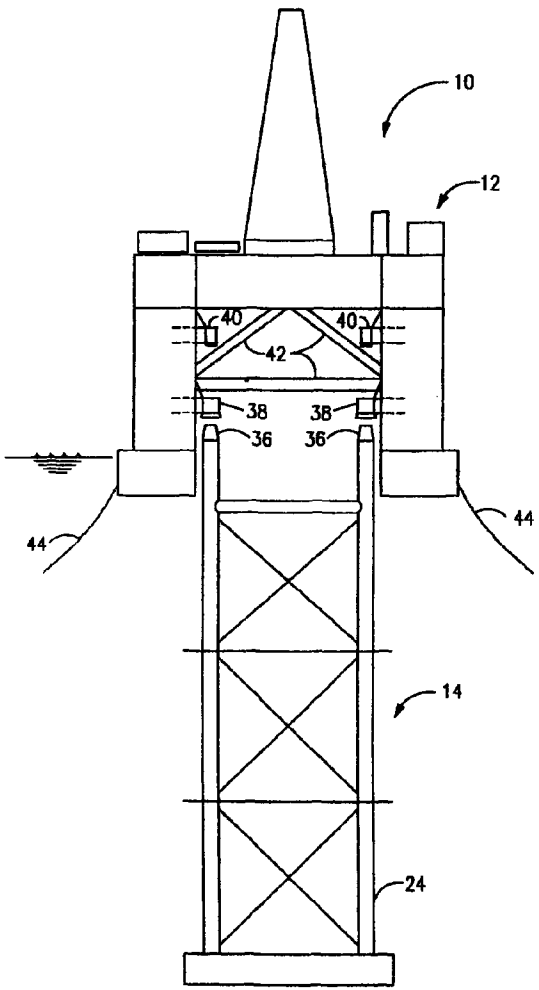
FIG. 7-9 illustrate the general assembly of the invention in the field.

As seen in FIG. 7, the truss frame 14 is then pulled into position under the hull 12 by any suitable means such as tug boats and/or winches on the hull. The upper ends 36 of the truss legs 24 are aligned with sleeves 38 and connectors 40.

Figure 2:
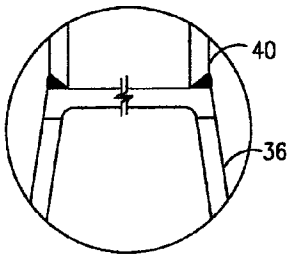
FIG. 2 is an enlarged detail view of the area indicated by numeral 2 in FIG. 1.
Figure 3:
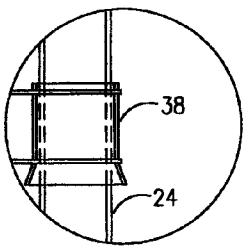
FIG. 3 is an enlarged detail view of the area indicated by numeral 3 in FIG. 1.
Figure 8:
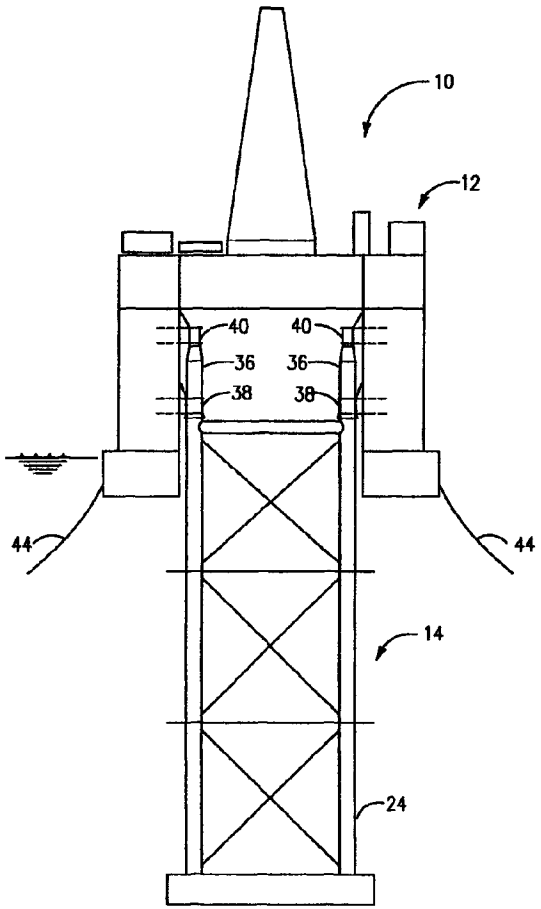

As seen in FIG. 8, the truss frame is deballasted so that the upper ends 36 of the legs 24 are received through the sleeves 38 and into contact with the connectors 40. This is best seen in the enlarged detail views of FIGS. 2 and 3.

The upper ends 36 of the legs 24 are rigidly attached to the connectors 40 by any suitable means such as welding. Grippers not shown may be used at the sleeves 38 to hold the legs 24 firmly in position until the welding is completed. Once welding to the connectors 40 is completed, it is preferable that the sleeves 38 and legs 24 be grouted together to increase the security of the connection between the hull 12 and truss frame 14.

Figure 9:
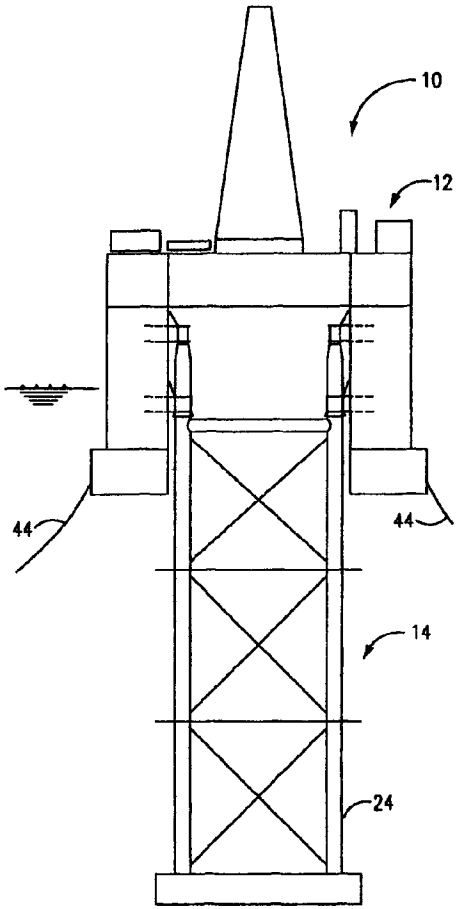

As seen in FIG. 9, the entire structure is then ballasted down to its normal operating draft. At the normal operating draft, the truss frame extends downwardly from the hull a sufficient distance in the water such that the horizontal plates effectively trap water in a manner that reduces the motions of the entire structure as described above.

Figure 10:
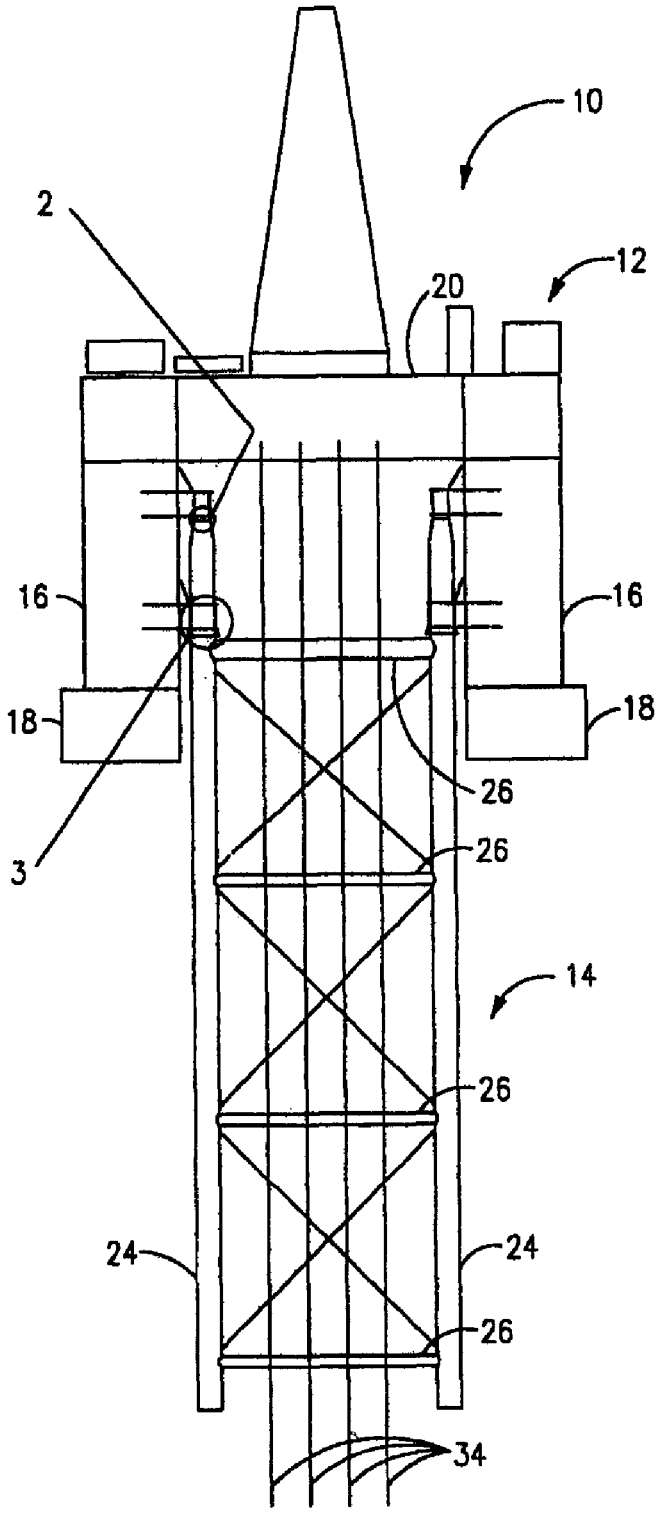
FIG. 10 illustrates an alternate embodiment of the invention.

FIG. 10 illustrates an alternate embodiment of the invention wherein no horizontal plates are used. Adjustable ballast means, if desired in the truss frame 14, may be provided in the legs 24.

The invention provides several advantages over the known art.

Known and proven construction techniques and equipment can be used without the need for experimentation to develop special construction techniques.

The generally known advantages of a conventional semi-submersible are present, with the additional advantages of reduced motions and superior stability.

The reduced motions of the invention allow the use of a dry tree riser arrangement.

The spacing of the columns 16 and number of bays in the truss frame 14 may be configured so that the semi-submersible 10 behaves hydrodynamically similar to a conventional semi-submersible or a truss spar.

The hull and truss frame may be fabricated at different locations, which can result in greater ease of fabrication and transportation planning.

The number and elevations of the heave plates can be designed to suit different environmental conditions.

The keel tank can be designed with or without fixed ballast to suit different environmental conditions.

The weight of the truss frame does not increase the hull buoyancy requirement since it replaces the weight of the ballast used in the pontoons in the prior known art.

The semi-submersible hull and truss frame are proven and accepted structures in the offshore industry.

Connection of two structures using a float over method is a proven and accepted installation method in the offshore industry.

The structure is easily decommissioned simply by reversing the installation process after it is towed to a chosen site.

The structure can accommodate both drilling and production operations.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A method for attaching offshore equipment together, comprising the steps:

a. floating a floating offshore structure capable of being used as a stand alone floating structure for offshore drilling or production into position such that a main portion of the floating offshore structure is above a water line;

b. floating a truss frame into position near the floating offshore structure such that a portion of the truss frame is above the water line, said truss frame having at least one horizontal heave plate below the water line that extends across the entire width and length of the truss frame;

c. moving the truss frame into vertical alignment with the floating offshore structure while maintaining the same draft for both;

d. adjusting the ballast of at least the truss frame or the offshore structure to cause the truss frame to contact the floating offshore structure at predetermined connection points above the water line; and e. rigidly attaching the floating offshore structure and truss frame together.

2. A method for attaching a floating semi-submersible hull with installed topsides to a truss structure, comprising the steps:

a. floating a semi-submersible hull capable of being used as a stand alone floating structure for offshore drilling or production into position such that a main portion of the semi-submersible hull is above a water line;

b. floating a truss frame into position near the semi-submersible hull such that a portion of the truss frame is above the water line, said truss frame having at least one horizontal heave plate below the water line that extends across the entire width and length of the truss frame;

c. moving the truss frame into vertical alignment with the semi-submersible hull while maintaining the same draft for both;

d. adjusting the ballast of at least the truss frame or the semi-submersible hull to cause the truss frame to contact the semi-submersible hull at predetermined connection points above the water line; and e. rigidly attaching the semi-submersible hull and truss frame together.

3. A method for attaching a floating semi-submersible hull with installed topsides to a truss structure, said semi-submersible hull being comprised of a plurality of columns supported at their lower ends by at least two pontoons and topside structural framing connecting the plurality of columns together at their upper ends, comprising the steps:

a. floating a semi-submersible hull capable of being used as a stand alone floating structure for offshore drilling or production into position such that a main portion of the semi-submersible hull is above a water line;

b. floating a truss frame into position near the semi-submersible hull such that a portion of the truss frame is above the water line, said truss frame having at least one horizontal heave plate below the water line that extends across the entire width and length of the truss frame;

c. moving the truss frame into vertical alignment with the semi-submersible hull while maintaining the same draft for both;

d. causing relative vertical movement between the truss frame and the semi-submersible hull to cause the truss frame to contact the semi-submersible hull at predetermined connection points above the water line; and e. rigidly attaching the semi-submersible hull and truss frame together.

* * * * *